United States Patent [19]

Wagner

[11] 4,427,498

[45] * Jan. 24, 1984

[54] SELECTIVE PLATING INTERIOR SURFACES OF ELECTRICAL TERMINALS

[75] Inventor: Richard M. Wagner, Harrisburg, Pa.

[73] Assignee: AMP Incorporated, Harrisburg, Pa.

[ * ] Notice: The portion of the term of this patent subsequent to May 20, 2000 has been disclaimed.

[21] Appl. No.: 458,005

[22] Filed: Jan. 17, 1983

Related U.S. Application Data

[63] Continuation-in-part of Ser. No. 361,956, Mar. 25, 1982, Pat. No. 4,384,926.

[51] Int. Cl.[3] ..... C25D 5/02; C25D 17/00

[52] U.S. Cl. ..... 204/26; 204/224 R; 204/225

[58] Field of Search ..... 204/26, 224 R, 225

[56] References Cited

U.S. PATENT DOCUMENTS

| | | | |
|---|---|---|---|
| 2,448,117 | 8/1948 | Pearson et al. | 204/225 |
| 2,477,808 | 8/1949 | Jones | 204/225 |
| 2,503,863 | 4/1950 | Bart | 204/225 |
| 3,410,781 | 11/1968 | Carlson et al. | 204/225 |
| 3,951,761 | 4/1976 | Bohringer et al. | 204/15 |
| 4,340,449 | 7/1982 | Srinivasan et al. | 204/224 R |
| 4,384,926 | 5/1983 | Wagner | 204/225 |

*Primary Examiner*—Arthur P. Demers

*Attorney, Agent, or Firm*—Katherine A. Nelson

[57] ABSTRACT

The present invention is characterized in that, a mandrel is rotated continuously as strip fed electrical terminals are strip fed continuously to the mandrel, and partially wrapped against the mandrel and exited from the mandrel, a conduit supplying plating fluid under pressure opens into a plurality of nozzles on the mandrel, anodes are mounted within the nozzles for reciprocation into and out of the interiors of the terminals that are against the mandrel, the conduit supplies plating solution under pressure to the nozzles, the nozzles inject plating solution into the interiors of those terminals in which the anodes are received, a source of electrical current supplies electrical current flowing from the anodes, through the plating solution and to the interiors of those terminals in which the anodes are received, and the anodes are constructed for withdrawal from the interiors of those terminals prior to those terminals exiting from the mandrel.

12 Claims, 23 Drawing Figures

1'
2'
3'
9'
13'
14'
15'
16'
16'
29'
54
56

SELECTIVE PLATING INTERIOR SURFACES OF ELECTRICAL TERMINALS

This application is a Continuation-in-Part of United States Application Ser. No. 361,956 filed on Mar. 25, 1982, now U.S. Pat. No. 4,384,926.

The present invention relates to selective plating; i.e., electroplating selectively, only the electrical contact surfaces of electrical terminals to the exclusion of other surfaces of the terminals. The terminals are stamped and formed from metal strip and are attached to a carrier strip which is useful for strip feeding the terminals through successive manufacturing operations. One necessary manufacturing operation involves plating; i.e., electroplating the electrical contact surfaces of the strip fed terminals with precious metal or semi-precious metal. These metals are characterized by good electrical conductivity and little or no formation of oxides that reduce the conductivity. Therefore, these metals, when applied as plating, will enhance conductivity of the terminals. The high cost of these metals has necessitated precision deposition on the contact surfaces of the terminals, and not on surfaces of the terminals on which plating is unnecessary.

Apparatus for plating is called a plating cell and includes an electrical node, an electrical cathode comprised of the strip fed terminals, and a plating solution; i.e., an electrolyte of metal ions. The plating solution is fluidic and is placed in contact with the anode and the terminals. The apparatus operates by passing electrical current from the anode, through the plating solution to the terminals. The metal ions deposit, as metal plating on those terminal surfaces in contact with the plating solution.

There is disclosed in U.S. Pat. No. 3,951,761, plating apparatus in which strip fed terminals are plated by immersion in a plating solution. The carrier strip is masked; i.e., covered by a conductive strip, that prevents deposition of plating into the immersed carrier strip. However, masking requires another manufacturing operation. Some immersed surfaces are difficult to mask, particularly the surfaces of small size electrical terminals. The present invention accomplishes selective plating according to a rapid automatic process and apparatus without a need for masking immersed terminal surfaces on which plating is unnecessary. The present invention is particularly adapted for plating only interior surfaces of strip fed, receptacle type, terminals, and not the external surfaces, despite contact of the external surfaces with plating solution.

The present invention is characterized in that, a mandrel is rotated continuously as strip fed electrical terminals are strip fed continuously to the mandrel, and partially wrapped against the mandrel and exited from the mandrel, a conduit supplying plating fluid under pressure opens into a plurality of nozzles on the mandrel, anodes are mounted within the nozzles for reciprocation into and out of the interiors of the terminals that are against the mandrel, the conduit supplies plating solution under pressure to the nozzles, the nozzles inject plating solution into the interiors of those terminals in which the anodes are received, a source of electrical current supplies electrical current flowing from the anodes, through the plating solution to the interiors of those terminals in which the anodes are received, and the anodes are constructed for withdrawal from the interiors of those terminals prior to those terminals exiting from the mandrel.

A better understanding of the invention is obtained by way of example from the following description and the accompanying drawings, wherein.

Figure 1:
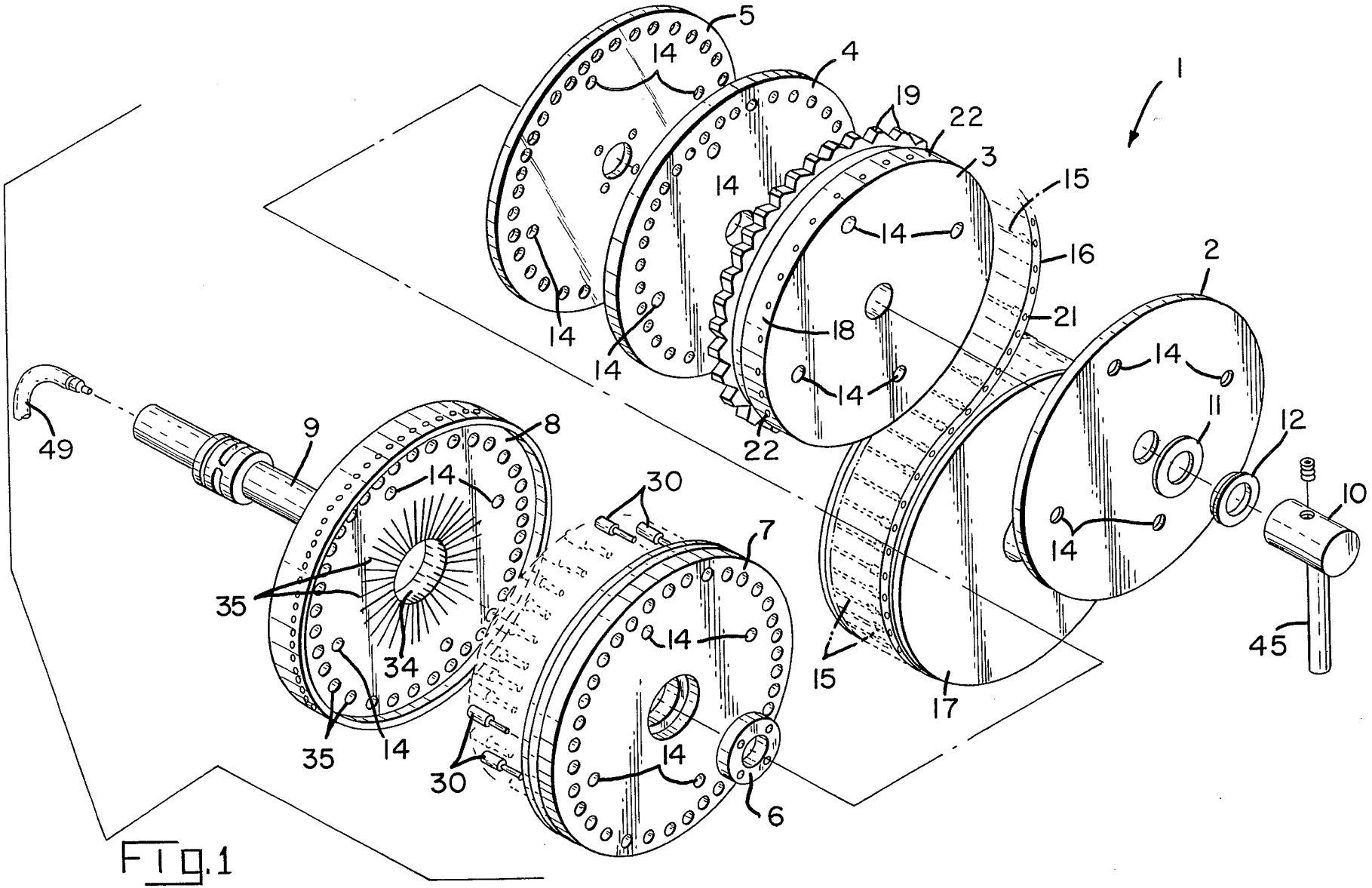
FIG. 1 is a perspective view of apparatus for continuous plating according to the invention with parts of the apparatus exploded.
Figure 2:
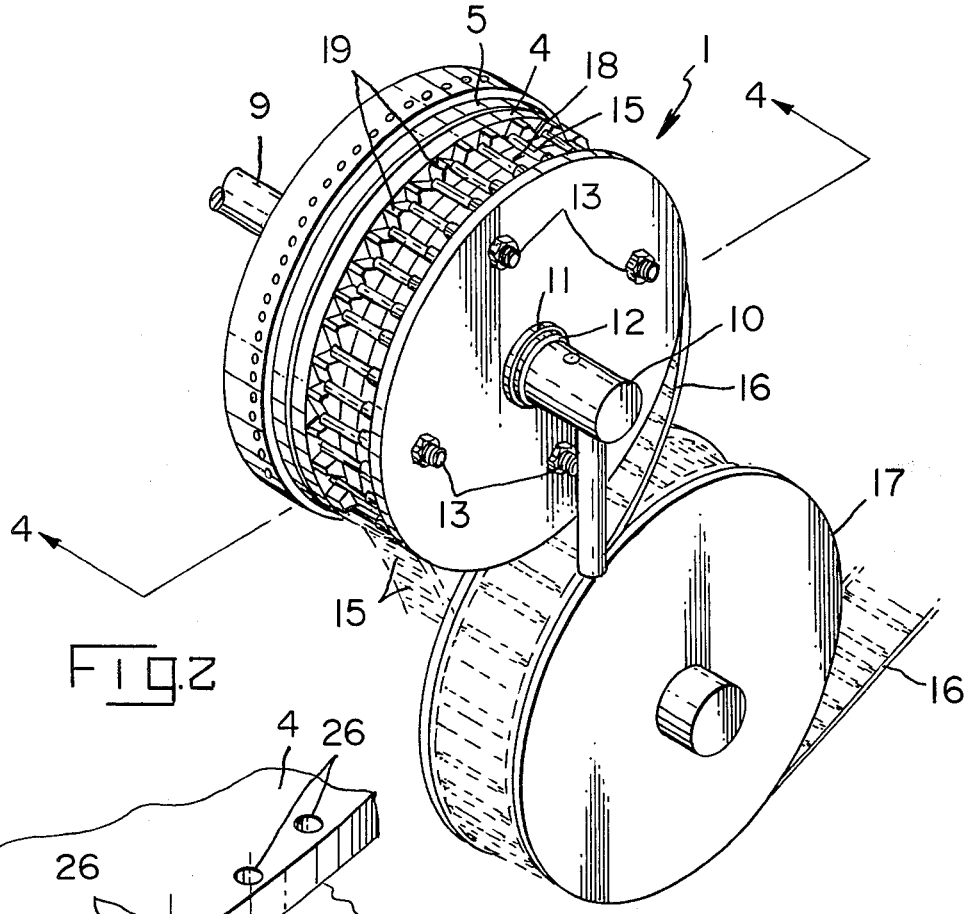
FIG. 2 is a perspective view of the apparatus shown in FIG. 1 with parts assembled.
Figure 2A:
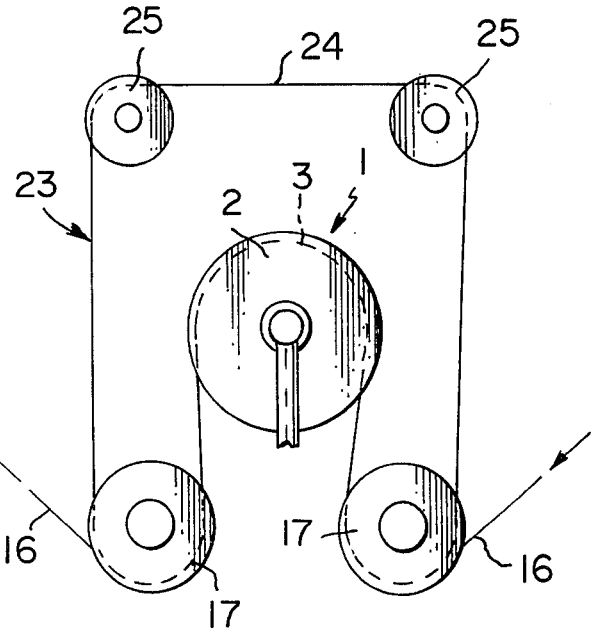
FIG. 2A is a schematic view of the apparatus shown in FIG. 2 combined with a belt mechanism.
Figure 4:
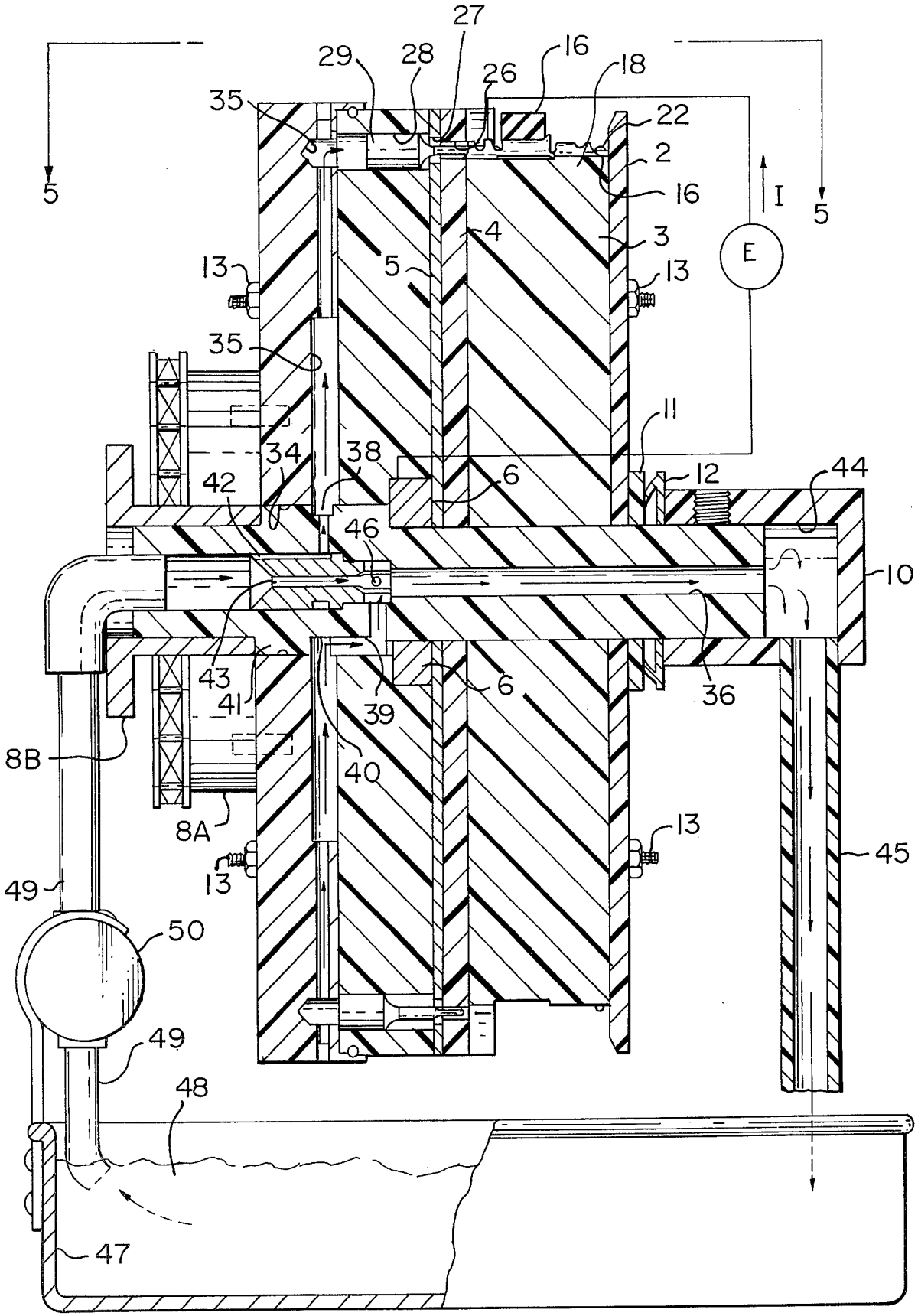
FIG. 4 is a view in section of a plating cell apparatus incorporated the apparatus of FIG. 2.

FIGS. 1, 2, 4 illustrate a mandrel apparatus 1 according to one embodiment of the invention comprising an assembly of, an insulative disc flange 2, an insulative wheel-shaped mandrel 3, an insulative nozzle plate 4, a conductive titanium, anode plate 5, a conductive copper-graphite bushing 6 that is attached to the anode plate 5, an insulative anode holder plate 7, an insulative hydraulic distributor plate 8, a shaft 9, an end cap 10 for fitting on the end of the shaft 9, a washer 11 and a sealing ring 12 compressed between the disc flange 2 and the end cap 10. The insulative parts 2, 3, 4, 7, 8 are advantageously machined from a high density polyvinylchloride, and are stacked together with the conductive parts 5 and 6. Bolts 13 are assembled through aligned bolt receiving holes 14 through each of the parts, 2, 3, 4, 5, 7, 8. These parts are mounted for rotation on the shaft 9. A continuous length of strip fed electrical terminals 15 are integral with, and serially spaced along, a carried strip 16. The terminals 15 are shown as electrical receptacles of barrel forms or sleeve forms. These forms are exemplary only, since many forms of electrical receptacles exist. The strip fed terminals 15 are shown in FIG. 2A as being looped over two idler pulleys 17 and onto a cylindrical alignment surface 18 of the mandrel 3.

Figure 3:
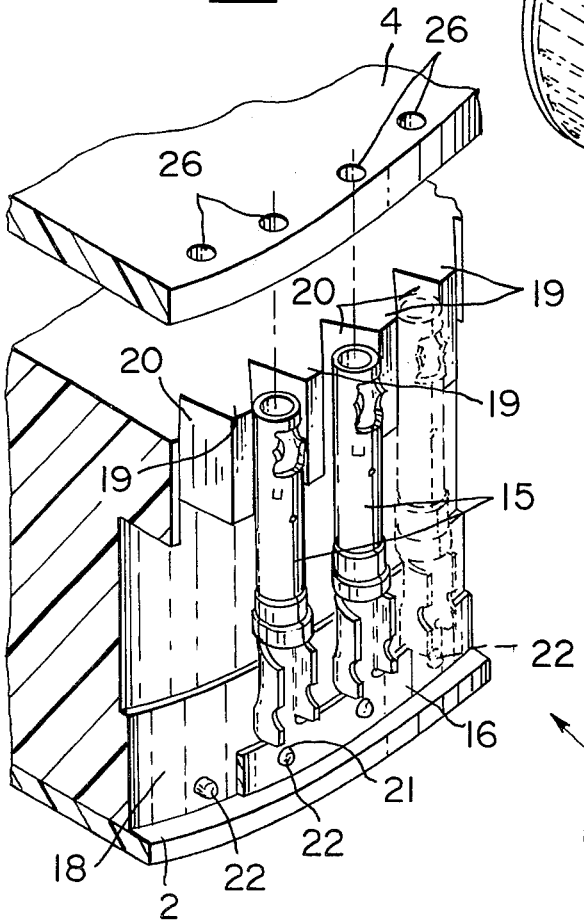
FIG. 3 is an enlarged fragmentary perspective view of a portion of the apparatus shown in FIG. 2.

FIG. 3 shows a series of radially projecting teeth 19 integral with and projecting from the alignment surface 18. The terminals 15 are nested in the spaces that form nests 20 between the teeth 19. The carrier strip 16 has pilot holes 21 in which are registered knobs 22 projecting from the mandrel 3. The flange 2 provides a rim projecting against and along the carrier strip 16. FIG. 2A illustrates a belt looped over the pulleys 17 and also over two additional pulleys 25. The belt 24 also is held by the pulleys 25 against the terminals 15 that are nested in the nests 20, and the belt retains these terminals 15 against the alignment surface 18 of the mandrel 3. Thereby the stripped terminals 15 are between the belt 24 and the alignment surface 18, whereas the belt 24 is between the strip fed terminals and the pulleys 17.

FIG. 3 shows a nozzle wheel 4 that is turreted with a plurality of radially spaced orifices or nozzles 26. FIGS. 1 and 4 show that the nozzles 26 are aligned with and open into the nests 20. These figures also show the anode plate 5 that includes a plurality of radially spaced, anode receiving openings 27 that are aligned with and open into the nozzle openings 26. The anode holder plate 7 includes a plurality of anode receiving chambers 28 aligned with and communicating with the openings 27 in the anode plate 5.

Figure 10:
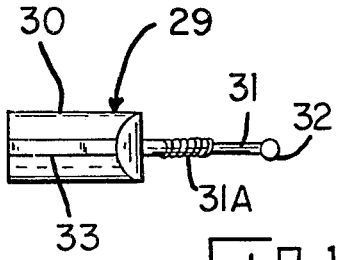
FIG. 10 is an elevation view of an anode of the apparatus shown in FIG. 2.

FIG. 10 shows an anode 29 machined from a conductive metal such as titanium. The anode has an enlarged diameter body 30 and a reduced diameter, elongated probe 31 integral with the body 30. A section of the probe 31 is fabricated of a coil spring 31A which makes a probe flexible. A radially projecting, insulative collar 32 is mounted on the tip of the probe 31. One or more flat passageways 33 are recessed in the periphery of the body 30 and extend longitudinally from one end of the body to the other.

Figure 5:
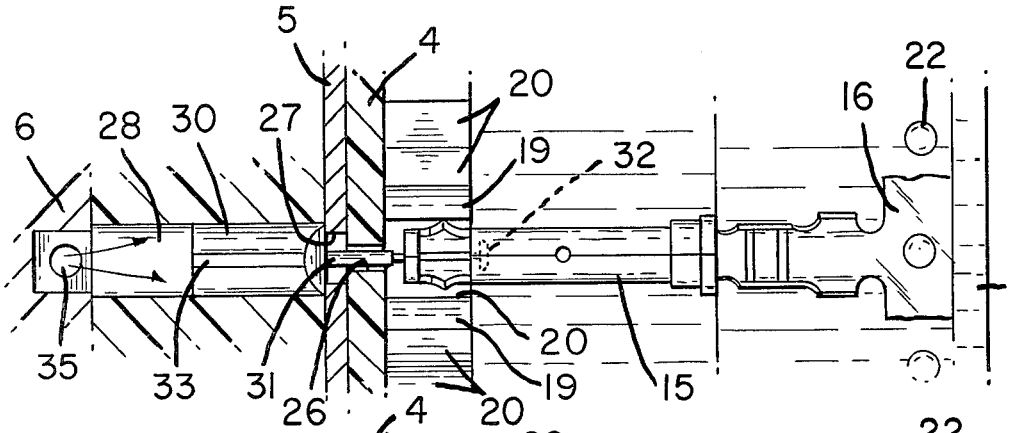
FIG. 5 is a fragmentary plan view, taken along the line 5—5 of FIG. 4, of a portion of the apparatus shown in FIG. 4, and illustrating an advanced anode.
Figure 6:
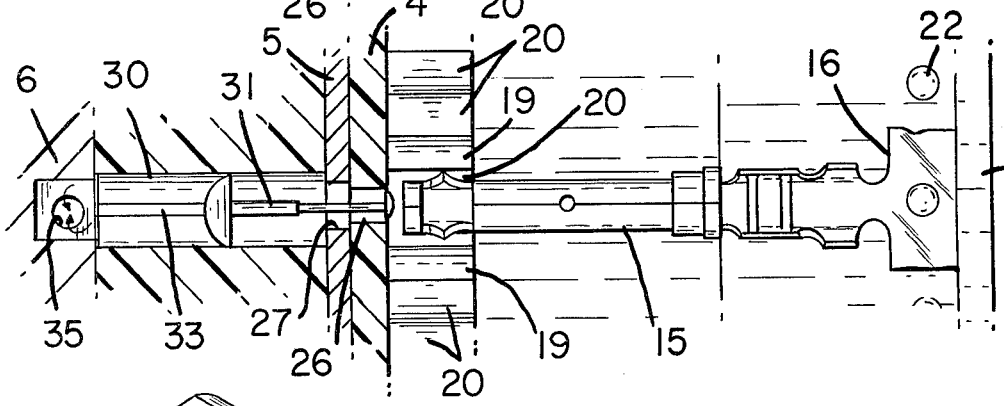
FIG. 6 is a view similar to FIG. 5, illustrating a retracted anode.

As shown in FIGS. 4, 5, 6, an anode body 30 is mounted for reciprocation in each chamber 28. The probe 31 of each anode body 30 projects into the openings 27, 26 that are aligned with the respective chamber 28. The aligned openings 27, 26, together with the chambers 28 cooperate to form anode passageways that mount the anodes 29 for reciprocation. The probe 31 of each anode 29 is mounted for advance into an interior of a terminal 15, as shown in FIG. 5, and also for retraction out of an interior of a terminal 15, as shown in FIG. 6. As each anode 29 is advanced into an interior of a terminal 15, the body 30 of the anode will impinge and stop against the anode plate 5, providing an electrical connection therebetween.

FIGS. 1, 4 show that the distributor plate 8 includes a central opening 34 communicating with a plurality of electrolyte passageways 35 that extend radially outward of the opening 34 and communicate with respective anode chambers 28.

Figure 7:
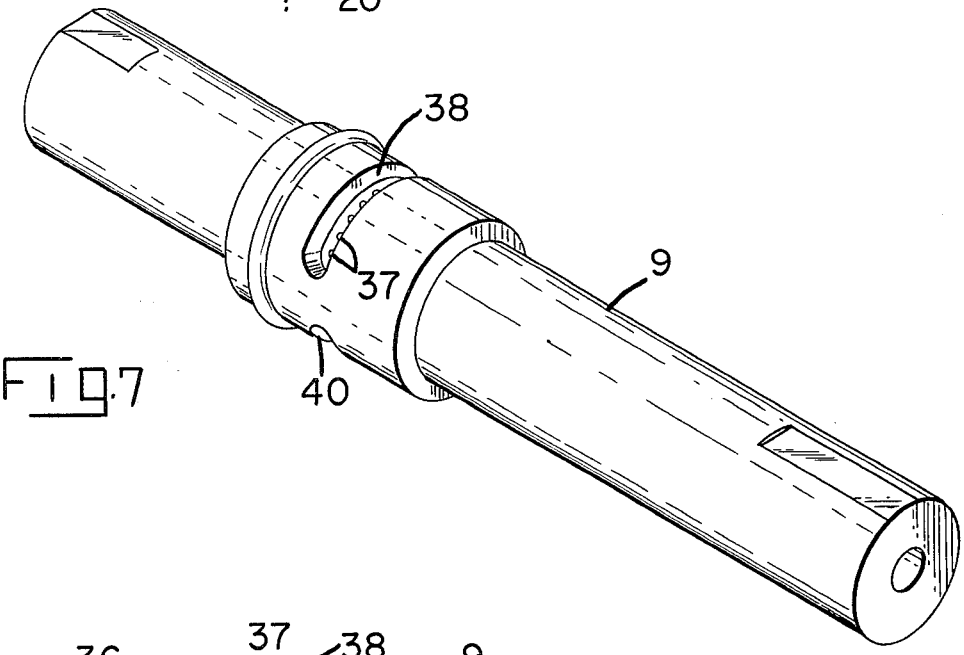
FIG. 7 is a perspective view of a shaft of the apparatus shown in FIG. 2.
Figure 8:
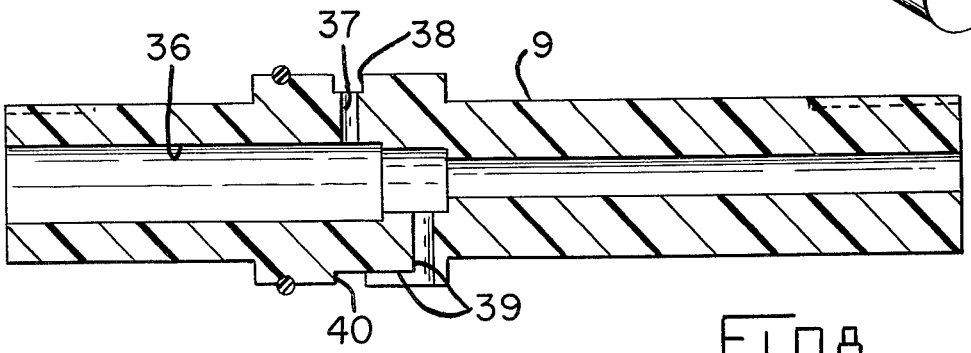
FIG. 8 is a section view of the shaft shown in FIG. 7.

FIGS. 7, 8 show the shaft 9 that is made of conductive stainless steel. The shaft 9 is provided with a central, stepped cylindrical, electrolyte conduit 36 extending entirely the length of the shaft. A plurality of electrolyte ports 37 connect the conduit 36 with a channel shaped, electrolyte inlet manifold 38 recessed in the cylindrical periphery of the shaft. A plurality of vacuum ports 39 connect the conduit with a channel shaped, vacuum manifold 40 that is recessed in the cylindrical periphery of the shaft 9, so that the central opening 34 of the plate 8 communicates with the manifolds 38, 40. The electrolyte passageways 35, that extend to the central opening 34, will communicate with the electrolyte inlet manifold 38, and then the vacuum manifold 40, in turn, as the distributor plate 8 is rotated relative to the shaft 9.

Figure 9:
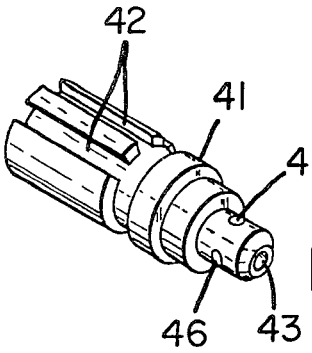
FIG. 9 is a perspective view of a vacuum aspirator of the apparatus shown in FIG. 2.

FIG. 9, taken with FIGS. 4 and 8, show a vacuum aspirator 41 machined from polyvinylchloride. The aspirator 41 is seated in the conduit 36 of the shaft 9. One or more longitudinal electrolyte passageways 42 are recessed in the periphery of the aspirator 41, and permit electrolyte flow along the conduit 36 into the ports 36 and the electrolyte inlet manifold 38. A longitudinal bore 43 through the aspirator 41 permits additional electrolyte flow through the aspirator 41, to the end of the conduit 36, through a passageway 44 through the end cap 10 and out a conduit 45 that is attached to the end cap 10 and communicates with the cap passageway 44. A series of vacuum ports 46 through the aspirator intercept the bore 43. The vacuum ports 46 communicate with the vacuum ports 39 and with the vacuum manifold 40. The electrolyte flow along the bore produces a vacuum in the vacuum ports 46 and also in the vacuum manifold 40. This phenomenon is well known in the art of hydraulic fluid devices.

FIG. 4 shows schematically a plating cell, including a source E of electrical potential applied across the strip 16 and the anode plate 5, a tank 47 containing a plating electrolyte 48 of precious or semi-precious metal ions and a supply hose 49 leading from the tank 47 through a pump 50 and into the conduit 36 of shaft 9. A drive sprocket with an axle bushing is secured on the distributor plate 8.

In operation, the sprocket is driven by a chain drive (not shown) to rotate the mandrel apparatus 1 and to feed the strip fed terminals 15 upon the mandrel 3. Electrolyte 48 is supplied under pressure from the hose 49 into the conduit 36 of the shaft 9. An electrical potential from the source E is applied between the anode plate 5 and the strip fed terminals 15 to produce a current I. The terminals 15 serve as a cathode onto which precious or semi-precious metal ions of the electrolyte 48 are to be plated. Upon rotation of the mandrel 3, each of the anode chambers 28, in turn, will communicate with the electrolyte manifold 38. The electrolyte will flow under pressure into the electrolyte manifold 38, and from there into several of the anode chambers 28 that communicate with the electrolyte manifold 38. The anodes 29 in these anode chambers 28 will be advanced to positions as shown in FIG. 5 by the electrolyte under pressure. Electrolyte will flow past the anodes 30 along the anode passageways 33, and be injected by the nozzles 26 into the interiors of the terminals 15, wetting the terminal interiors and the anode probes 31 which are in the terminal interiors. Sufficient ion density and current density are present for the ions to deposit as plating upon the surfaces of the terminal interiors. The proximity of the probes 31 to the terminal interiors assures that the surfaces of the terminal interiors are plated, to the exclusion of the other terminal surfaces. The collars 32 on the anodes are sized nearly to the diameters of the interiors of the terminals to position the anode probe precisely along the central axis of the terminal interiors during the plating operation.

As the mandrel apparatus 1 is further rotated, the anode chambers 28 will become disconnected from the electrolyte manifold 38, and will become connected with the vacuum manifold 40. The vacuum present in the vacuum manifold 40 will tend to draw out residual electrolyte in the several anode chambers 28 that communicate with the vacuum manifold 40. The vacuum also will retract the anodes 29 from their advanced positions, as shown in FIG. 5, to their retracted positions, shown in FIG. 6. Thereby, the probes 31 become withdrawn from the interiors of the terminals 15, plating deposition will cease, and the terminals become removed from the mandrel apparatus 1 as the strip 6 continues to be advanced.

Figure 13:
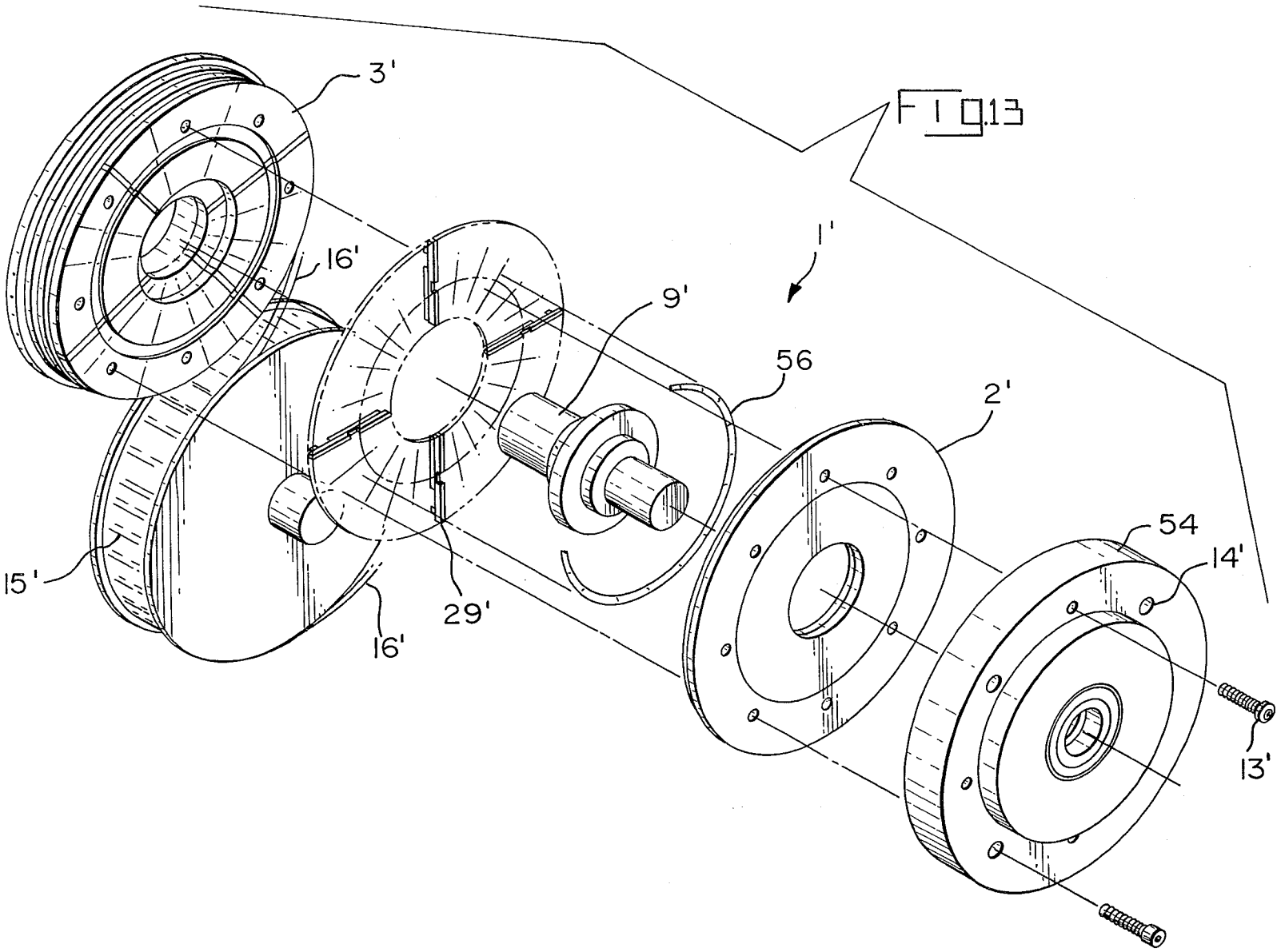
FIG. 13 is an exploded view of an alternative embodiment of this invention.
Figure 15:
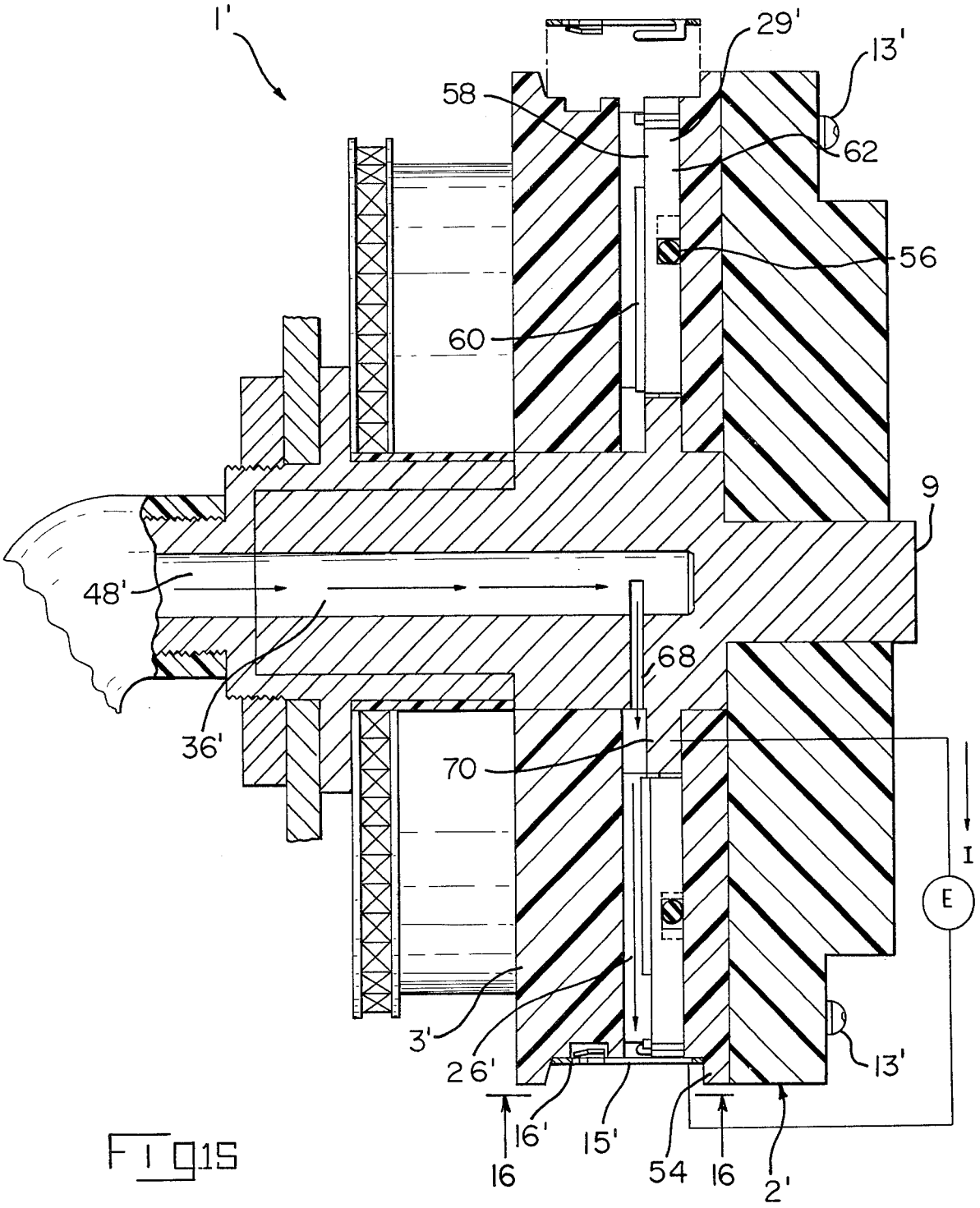
FIG. 15 is a view in section of a plating cell apparatus incorporating the alternative embodiment of FIG. 13 in the apparatus of FIG. 2.

FIGS. 13 and 15 illustrate a mandrel apparatus 1' according to an alternative embodiment of the invention comprising an assembly of an insulative bearing case 54, a two piece insulative disc flange 2', an insulative wheel shaped mandrel 3', an anode-spreader retaining ring 56, and a conductive shaft 9'. Bolts 13' are assembled through aligned bolt receiving holes 14' through each of the parts 54, 2', and 3'. These parts are mounted for rotation on the shaft 9'. A continuous length of strip fed electrical terminals 15' are integral with, and serially spaced along, a carrier strip 16'. The strip fed terminals 15' are strip fed to the apparatus 1' in the same manner as are the strip fed terminals 5 as shown in FIG. 2A.

Figure 14:
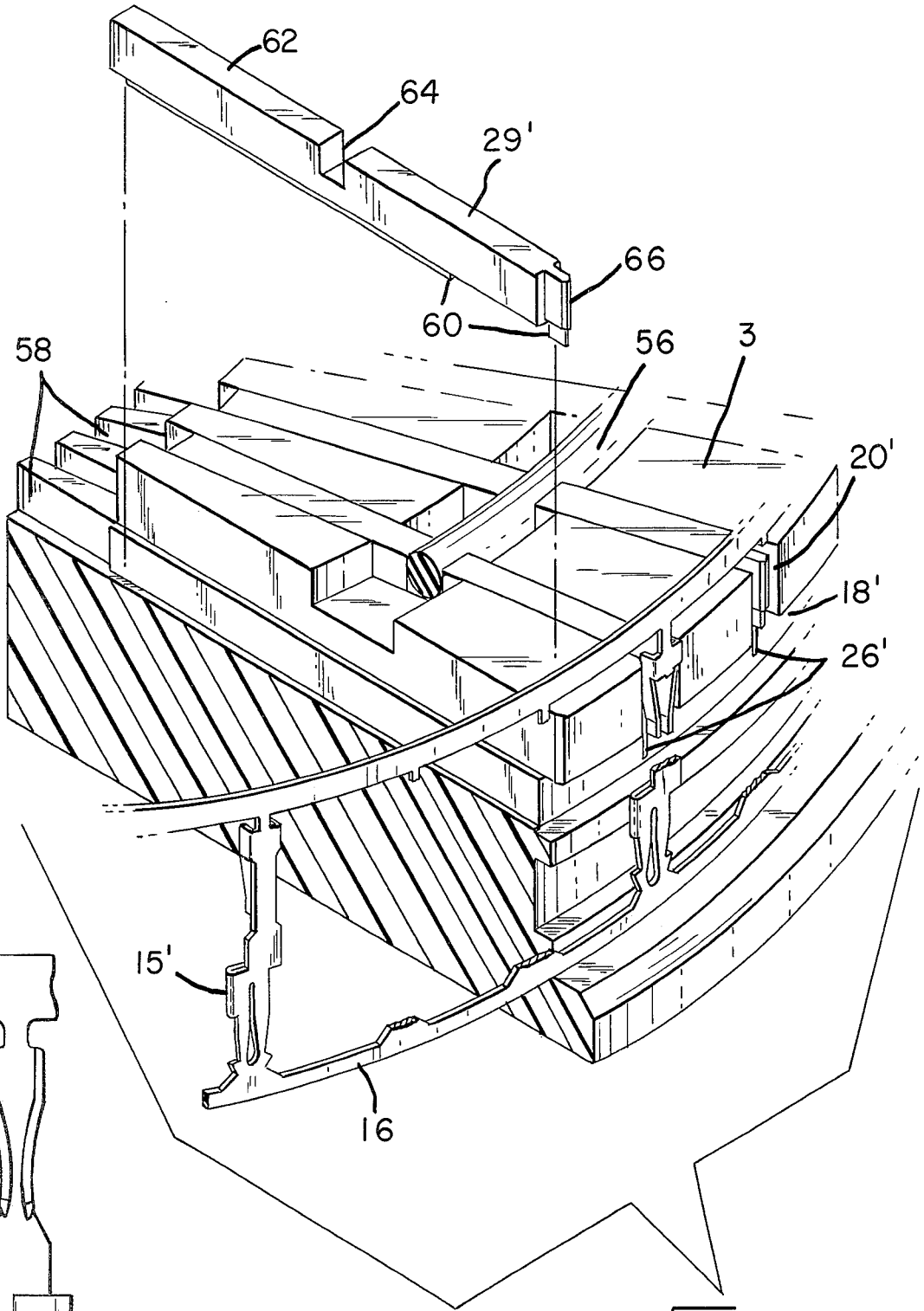
FIG. 14 is an enlarged fragmentary perspective view of a portion of an alternative embodiment of the apparatus shown in FIG. 2.
Figure 14A:
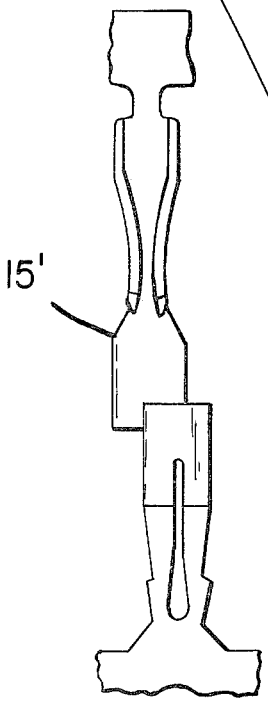
FIG. 14A is a plan view of a terminal having a contact slot receptacle showing the side of the terminal that faces the mandrel.

This embodiment of the invention is used with electrical terminals having contact slot receptacles of the type shown in FIG. 14A. In order to plate inside a slotted terminal, according to the invention, the slot first must be spread apart to permit insertion of the anode. As is illustrated in FIGS. 13 and 14, anode-spreaders 29' are used in this embodiment. The anode-spreaders 29' are inserted essentially at right angles to the terminals 15'. FIG. 14 shows that each anode-spreader 29' is comprised of a conductive metal strip 60 and a plastic spreader body 62. The metal strip 60 extends below the plastic spreader. The plastic spreader body 62 has a retaining slot 64 along its upper edge which cooperates with the anode-spreader retaining ring 56. The anode-spreader is shaped at its outermost end 66 to spread and fit within the terminals 15' and to properly position the metal anode portion inside the terminal.

FIG. 14 shows that mandrel 3' is turreted with a plurality of radially spaced anode-spreader passageways 58 which extend outwardly to the alignment surface 18' and form a series of nests 20' along the periphery mandrel 3'. The terminals 15' are held in these nests and against the mandrel as the terminals are plated internally.

FIG. 14 further shows that mandrel 3' is turreted with a plurality of radially spaced orifices or nozzles 26' at the base of the anode-spreader passageways 58. When the anode-spreaders 29' are placed in the mandrel, the metal strips 60 lie within the nozzles 26'.

Figure 16:
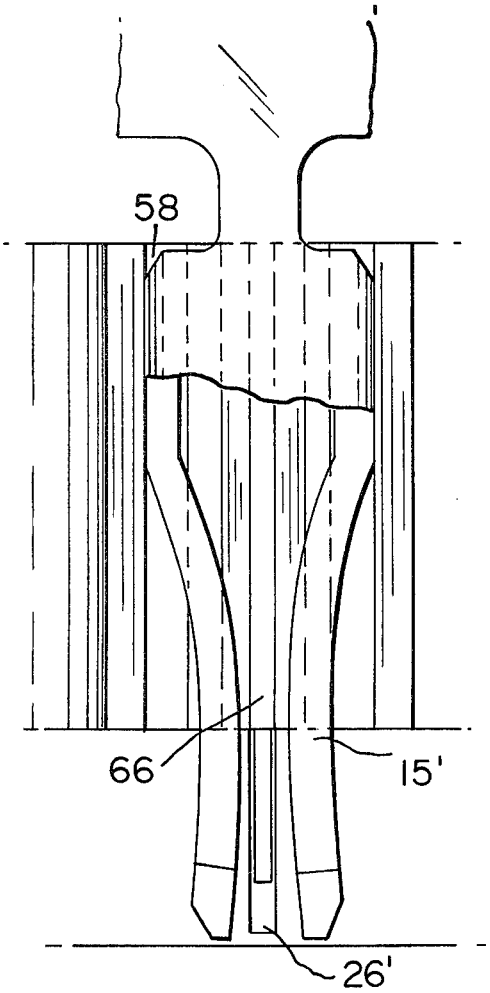
FIG. 16 is a fragmentary plan view taken along the line 16—16 of FIG. 15, and illustrating an anode-spreader aligned to enter the terminal.
Figure 17:
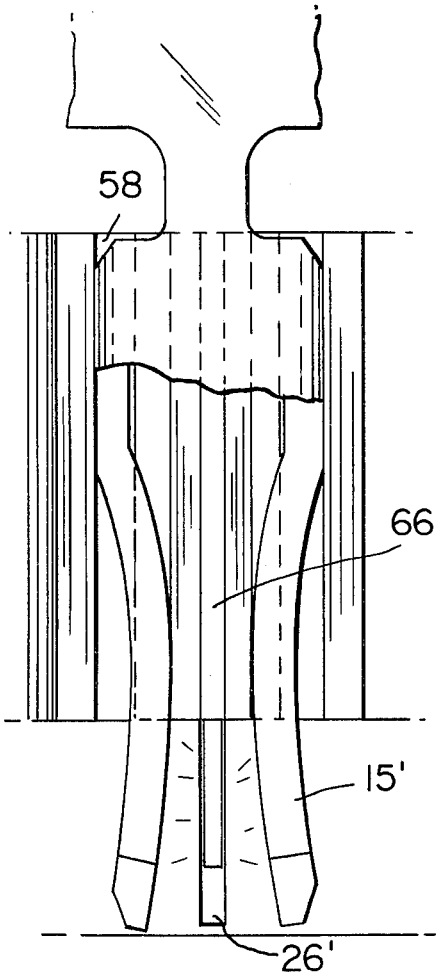
FIG. 17 is a view similar to FIG. 16, illustrating an advanced anode-spreader.

As shown in FIGS. 14, 15, 16, and 17, the anode-spreader 29' is mounted for reciprocation in each passageway 58. The shaped end 66 of each anode-spreader is mounted for advancing into the slot of a terminal 15' as shown in FIG. 16. FIG. 17 shows the advanced anode-spreader in the terminal 15'. As each anode-spreader 29' is advanced it is held in contact with the conductive shaft 9', providing an electrical connection therebetween.

Figure 18:
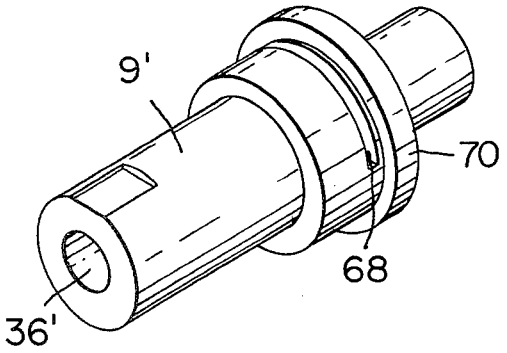
FIG. 18 is a perspective view of the shaft of the apparatus shown in FIG. 15, illustrating the asymmetric cam used to advance and retract the anode-spreaders.
Figure 19:
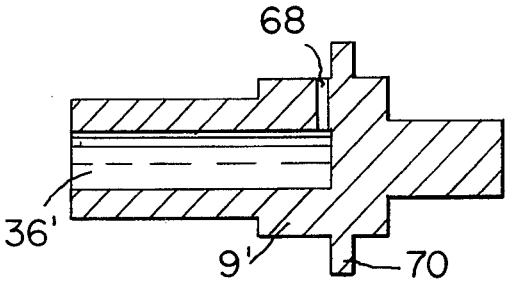
FIG. 19 is a section view of the shaft shown in FIG. 18.

FIGS. 15, 18 and 19 show the conductive shaft 9' is provided with a central, cylindrical electrolyte conduit 36' extending along part of the length of the shaft. A channel shaped electrolyte outlet 68 is recessed in the cylindrical periphery of the shaft 9'. As the mandrel 3' revolves about shaft 9', the nozzles 26' communicate with the electrolyte outlet 68 thus providing access of the electrolyte solution to the terminal 15'.

Figure 20:
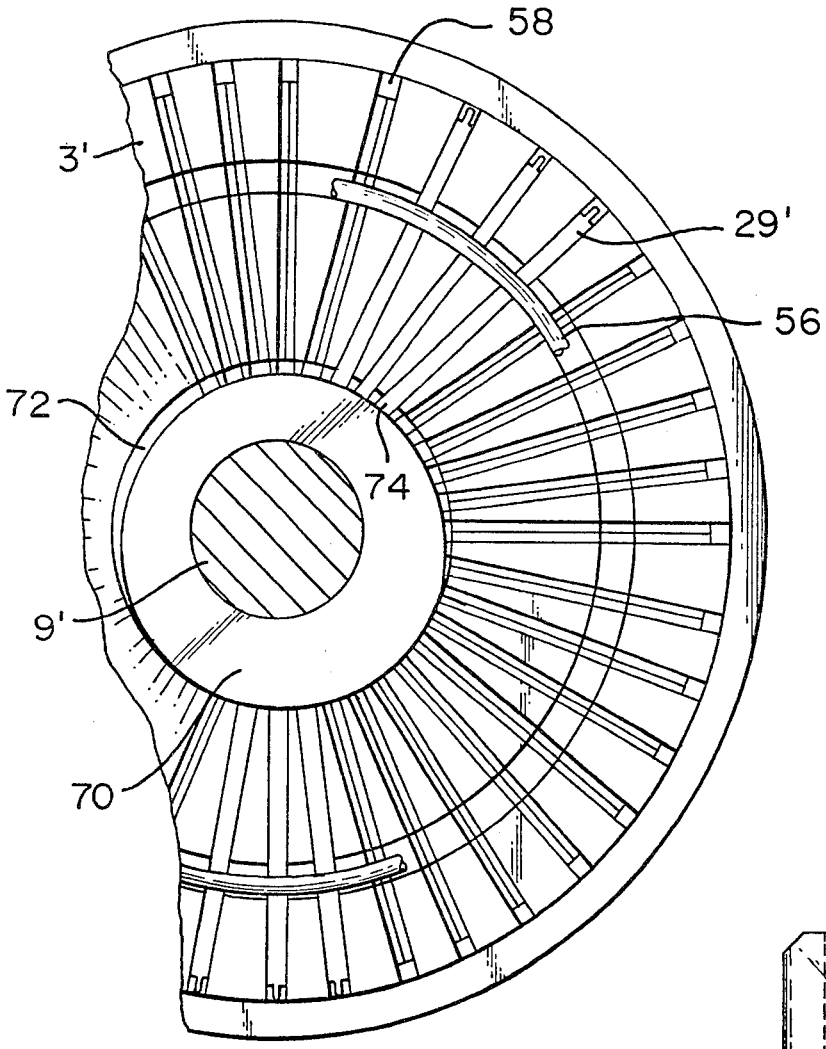
FIG. 20 is an enlarged fragmentary perspective view of the alternative embodiment of FIG. 13 illustrating the operation of the asymmetrical cam.

FIGS. 15, 18 and 19 show the asymmetric cam 70 on the shaft 9'. The shape of cam 70 can be seen in FIG. 20. Mandrel 3' has a circular opening 72 at its center which is dimensioned to closely fit and cooperate with shaft 9'. The cam 70 fits into a circular opening 72 on the side of mandrel 3' having the anode-spreader passageways 58. Approximately half of cam 70 fits snugly against passageways 58 while the other part of cam 70 is spaced apart from passageways 58. The inner ends 74 of anode-spreaders 29' are held snugly against cam 70 by the anode-spreader retaining ring 56.

As mandrel 3' rotates around shaft 9', the anode-spreaders 29' are first extended into the terminals 15' as cam 70 moves against passageways 58 and then retracted from terminals 15' where the cam is spaced apart from said passageways.

FIG. 15 shows schematically the mandrel apparatus, including a source E of electrical potential applied across the strip 16 and the conductive shaft 9'. A drive sprocket with an axle bushing is secured to the mandrel 3'.

In operation, the sprocket is driven by a chain drive (not shown) to rotate the mandrel apparatus 1' and to feed the strip fed terminals 15' upon the mandrel 3'. Electrolyte 48' is supplied under pressure from a plating bath (not shown) into the conduit 36' of the shaft 9'. An electrical potential from the source E is applied between the shaft 9' and the strip fed terminals 15' to produce a current I. The terminals 15' serve as a cathode onto which precious or semi-precious metal ions of the electrolyte 48' are to be plated. Upon rotation of the mandrel 3', each of the nozzles 26', in turn, will communicate with the electrolyte outlet 68. The electrolyte will flow under pressure into the electrolyte outlet 68, and from there into several of the nozzles 26' that communicate with the electrolyte outlet 68. The anodes 29' in these anode-spreader passageways 58 will be advanced to positions as shown in FIG. 17 by action of the asymmetric cam 70. Electrolyte will flow past the metal portion of the anode-spreader 29' into the interiors of the terminals 15', wetting the terminal interiors and the portion of the anodes which are in the terminal interiors. Sufficient ion density and current density are present for the ions to deposit as plating upon the surfaces of the terminal interiors. The proximity of the anode-spreader end 66 to the terminal interiors assures that the surfaces of the terminal interiors are plated to the exclusion of the other terminal surfaces. Excess electrolyte will flow past the anode-spreader and will be returned to the plating bath (not shown).

As the mandrel apparatus 1' is further rotated, the passageways 58 will become disconnected from the electrolyte outlet 68. The action of cam 70 will cause the anode-spreader to withdraw from the interiors of the terminals 15', and plating deposition will cease. The terminals become removed from the mandrel apparatus 1' as the strip 16' continues to advance.

In this alternative embodiment 1' of the mandrel apparatus, the use of mechanical means to reciprocally move the anode-spreaders into and out of the terminals eliminates a number of parts that are necessary for the hydraulically operated mechanism to provide reciprocating movement. Mechanical means can also be used with mandrel apparatus 1. The use of anode-spreaders inserted at right angles to the terminals instead of a straight line insertion also reduces the number of parts required for the mandrel apparatus.

Because the slots in the terminals used in embodiment 1' must be spread apart to permit insertion of the anode, the anode-spreaders do become worn after a period of time. Depending upon the type of plastic used, over 25,000 insertions per anode can be made before replacement is necessary. The worn anode-spreaders are designed to be disposable and are easily replaced by removing bolts 13, and separating the three main pieces. The anode-spreader retaining ring is then removed and new anode-spreaders inserted. Flange 2' is made in two parts to facilitate replacement of the anode-spreader retaining ring.

The present invention relates additionally to an electrical receptacle that has an interior with a noble metal or noble metal alloy deposit applied by the apparatus described in conjunction with FIGS. 1–10 or FIGS. 13–20. The deposit has observable characteristics that distinguish from characteristics of plating applied by apparatus and a process other than that described in conjunction with FIGS. 1–10 or 13–20. A standard requirement of the electrical industry is, that an electrical receptacle of base metal, copper or its alloy, should be plated first with nickel or its alloy, then have its interior plated with a precious or semi-precious metal such as cobalt-gold alloy that assures electrical conductivity. Further, the plating must equal or exceed a specified thickness, that allows for wear removal of the layer by abrasion. For example, one standard specification requires 15 microinches thickness of cobalt-gold plating extending from the end of the receptacle to a depth of 0.200 inches within the receptacle interior. The exterior surfaces of the receptacle are not subject to wear removal. Therefore, only a flash; i.e., five millionths of an inch in thickness of plating is required.

The deposit of noble metal or noble metal alloy may also be comprised of successive layers of noble metals such as gold, palladium, platinum, silver or their alloys. Successive layers of different noble metals may also be plated on one another, such as an under layer of palladium followed by an over layer of gold.

Heretofore, plating of electrical receptacles was accomplished by the prior processes of, plating over a strip of base metal prior to forming the strip into receptacle configurations, or by immersing fully formed electrical receptacles in plating electrolyte and plating all the surfaces of the receptacles. Each of these prior processes had disadvantages.

Forming a base metal strip subsequent to plating applies bending stresses in the plating. Observation by a microscope would reveal stress cracks in the surface of the outer plating layer. The cracks would be most prevalent in the areas of most severe bending. Severe bending also would cause localized separations of the outer plating layer from the metal underlying the outer plating layer. These separations called occlusions, would be observed by microscopic observation of a cross-section of the outer plating layer and the underlying metal. These stress cracks and occlusions are defects that would permit corrosion of the underlying base metal and would be adverse to quality of the outer plating layer. Further, stamping of the plated base metal produces shears through the plating layers, exposing the base metal underlying the plating.

Figure 11:
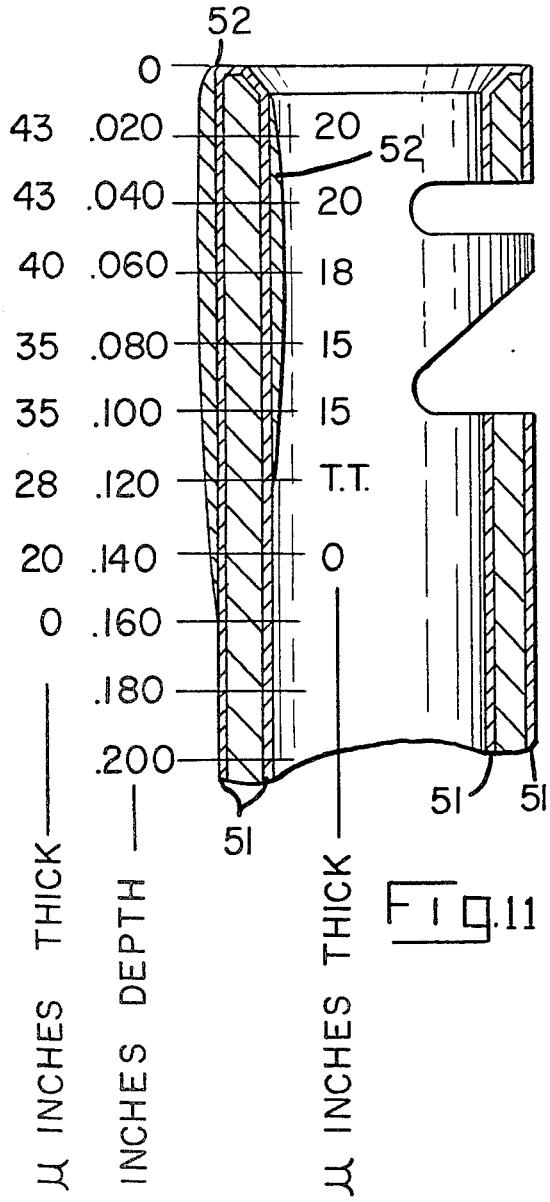
FIG. 11 is an elevation view in section of a portion of an electrical receptacle that has been immersion plated.

FIG. 11 depicts a cross-section of an electrical receptacle plated with a layer of nickel 51, and then immersion plated in cobalt-gold electrolyte, using an anode external to the receptacle during plating. Both the interior and the exterior of the receptacle receive plating deposit 52. The deposit on the interior rapidly tapers in thickness from the end of the receptacle toward the innermost depth of the receptacle. For example, the thickness varies from 20 microinches at the end of the receptacle to zero thickness at a depth of 0.140 inches from the end of the receptacle. This tapered characteristic results from the progressive, exponential decrease in charge density or current density due to distance from the external anode. So that thinner portions of the tapered deposit will meet the requirement for minimum thickness, other portions of the deposit must have excess thickness that wastefully consumes the plating ions of the electrolyte. Since the exterior of the receptacle is relatively near the external anode, the deposit is thicker than the deposit on the receptacle interior. For example, the deposit has a thickness of 43 microinches at a depth of 0.02 inches, and a thickness of 20 microinches at a depth of 0.14 inches. Deposit on the exterior of the receptacle is not subjected to wear removal. Therefore, any plating in excess of a flash, i.e., approximately five millionths of an inch in thickness, is wasted consumption. Masking, i.e., covering the receptacle exterior during plating will eliminate the exterior deposit. However, masking requires an operation prior to plating and is not conducive to a mass production process. Further, masking does not eliminate wasteful consumption of a tapered deposit on the interior of the receptacle. Upon removal of the masking, an abrupt, not tapered, edge of the plating would be observed where the plating had met the masking.

Figure 12:
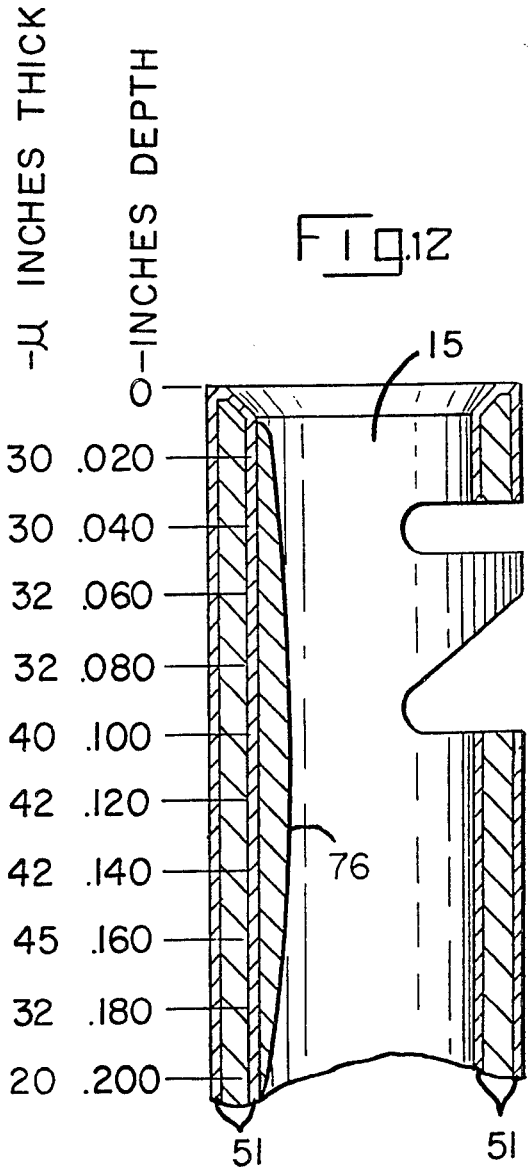
FIG. 12 is an elevation view in section of an electrical receptacle that has been plated according to the present invention.

In the receptacle 15 of the present invention, shown in FIG. 12, the receptacle is stamped and formed from a base metal of copper or its alloy. A layer of nickel or its alloy is plated over all surfaces of the receptacle, including the sheared edges produced during the stamping and forming operations. Using the apparatus as described in conjunction with FIGS. 1–10, the interior is plated with an outer layer 76 of a precious or semi-precious metal, such as gold, platinum, palladium or silver, or the alloys thereof, such as cobalt-gold. For example, an outer layer of plating in the form of cobalt-gold of relatively even thickness is deposited along the length extending from the end of the receptacle to a distance of 0.200 inches toward the innermost depth of the interior. An abrupt and steep taper is at the edges of the plating. There is an absence of cobalt-gold, of equal or greater thickness, on the receptacle exterior. The even thickness and abrupt, tapered edges are characteristics of the plating deposit achieved by selective plating according to the invention. The length of the plating deposit substantially is equal to the length of the anode probe 31 that extends within the receptacle interior. At the terminal end of the probe 31, the charge and current densities abruptly cease, causing an abrupt, tapered edge of the plating deposit. The charge and current densities also cease at the chamfered end of the receptacle, causing an abrupt, tapered edge of the plating deposit. There is no need for masking the receptacle exterior, and the plating deposit does not have the nontapered edge that would result from masking. Further, the plating deposit is substantially free of stress cracks and occlusions, and has a grain structure characteristic of plating deposit.

Figure 21:
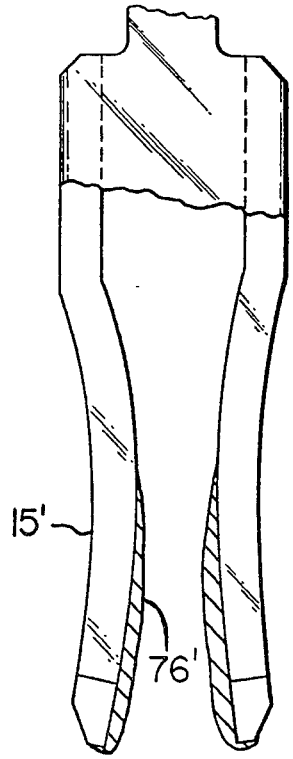
FIG. 21 is an enlarged fragmentary view of an electrical terminal that has been plated according to the alternative embodiment of the present invention.

FIG. 21 shows a receptacle 15' plated, using the apparatus as described in conjunction with FIGS. 13–20. The plating deposit 76' on the interior surface of 15' has the same characteristics as the plating deposit 76 on terminal 15, as shown in FIG. 12.

The invention has been described by way of examples only. Other forms of the invention are to be covered by the spirit and scope of the claims. The receptacles 15 and 15' are only exemplary of the many forms of electrical receptacles, the internal surfaces of which are capable of being plated by the apparatus of the invention.

What is claimed is:

1. An apparatus for plating interior surfaces of electrical terminals that are spaced apart and attached to a carrier strip, that is utilized to strip feed the terminals, comprising:

a mandrel continuously rotated as strip fed electrical terminals are continuously fed to the mandrel, partially wrapped against the mandrel, and exited from the mandrel, the mandrel being turreted with a plurality of nozzles distributed about the mandrel's axis of rotation, anode-spreaders mounted within the nozzles, for reciprocation into and out of the interiors of the terminals that are against the mandrel, a conduit supplying plating solution under pressure through the nozzles and upon the anode-spreader, the nozzles injecting plating solution into the interiors of the terminals in which the anode-spreaders are received, a source of electrical potential for supplying electrical current flow from the anode-spreader through the plating solution and into the interiors of the terminals in which the anode-spreaders are received, and the anode-spreaders being constructed for retraction from the interiors of the terminals.

2. The apparatus according to claim 1, in which the mandrel is rotatably mounted on a shaft, the periphery of the shaft includes an inlet manifold that communicates with the conduit and the interior of the mandrel, the nozzles communicate with the interior of the mandrel and become in communication with the inlet manifold upon revolution of the mandrel interior about the shaft.

3. The apparatus according to claim 1, in which an asymmetric cam reciprocally moves the anode-spreaders into and out of the interior of the terminals.

4. The apparatus according to claim 2, in which an asymmetric cam reciprocally moves the anode-spreaders into and out of the interior of the terminals.

5. A series of electrical terminals serially along a common, integral carrier strip, in which each terminal includes a receptacle portion, comprising:

internal surfaces of each said receptacle have a deposit of noble metal or an alloy of noble metal plated over the base metal, the interior plated deposit having a thickness in excess of 15 millionths of an inch, edge margins of the interior plated deposit being of tapered thickness and covering at least portions of the sheared edges of the blank which are sheared by stamping, and the external surfaces of each receptacle being substantially free of said noble metal plating and further having a flash of approximately five millionths of an inch in thickness of a nobel metal, such as gold, platinum, palladium, silver, or the alloys thereof.

6. The series of terminals according to claim 5, wherein the interior plating deposit is a metal selected from the group consisting of gold, platinum, palladium, silver, their alloys, or successive layers of these metals plated on one another.

7. The series of terminals according to claim 5, wherein the interior plated deposit is substantially free of stress cracks and has a grain structure characteristic of a plating deposit.

8. The series of terminals according to claim 6, wherein the base metal is copper or its alloy that is plated over with nickel or its alloy, and the sheared edges of the blank also are plated over with nickel or its alloy.

9. The series of terminals according to claim 7, wherein the base metal is copper or its alloy that is plated over with nickel or its alloy, and the sheared eges of the blank also are plated over with nickel or its alloy.

10. A process for plating the interior surfaces of electrical terminals comprising the steps of:

feeding a series of formed electrical terminal bodies on strip onto an alignment surface of a plating cell fixture, aligning the interiors of the formed bodies with anode-spreaders shaped to enter the formed bodies, and reciprocably retained in nozzles of the plating cell fixture, projecting portions of the anode-spreaders outwardly of the nozzles and into the interiors of the formed bodies during plating, jetting streams of plating solution through the nozzles and over the anode portion of the anode-spreader in the nozzles, supplying electrical potential between the strip and the advanced anode portion so that plating is applied to the interior surfaces of the formed bodies that are in proximity to the advanced anode portion of the anode-spreaders, retracting the anode portions from the interior of the bodies and into the nozzles.

11. The process according to claim 10, wherein the anode portions are advanced into and retracted from the terminal bodies by means of an asymmetric cam.

12. The process according to claim 10, and further including the step of, advancing the electrodes within the nozzles to register in a space within the interior surfaces of the receptacle.

* * * * *

UNITED STATES PATENT OFFICE

CERTIFICATE OF CORRECTION

Patent No. 4,427,498 Dated Jan. 24, 1984

Inventor(s) Richard M. Wagner

It is certified that error appears in the above-identified patent and that said Letters Patent are hereby corrected as shown below:

On cover page please change the Notice to read:

[*] NOTICE: The portion of the term of this patent subsequent to May 24, 2000 has been disclaimed.

Signed and Sealed this

*Seventh* Day of *August 1984*

[SEAL]

*Attest:*

GERALD J. MOSSINGHOFF

*Attesting Officer* *Commissioner of Patents and Trademarks*